US008977152B2

(12) United States Patent
Shimizu

(10) Patent No.: US 8,977,152 B2
(45) Date of Patent: Mar. 10, 2015

(54) IMAGE FORMING APPARATUS HAVING DEVELOPER STIRRING CONTROL

(71) Applicant: Canon Kabushiki Kaisha, Tokyo (JP)

(72) Inventor: Kazumichi Shimizu, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 13/778,296

(22) Filed: Feb. 27, 2013

(65) Prior Publication Data

US 2013/0223862 A1 Aug. 29, 2013

(30) Foreign Application Priority Data

Feb. 29, 2012 (JP) ..... 2012-043947

(51) Int. Cl.
*G03G 15/10* (2006.01)
*G03G 15/08* (2006.01)
*G03G 15/00* (2006.01)

(52) U.S. Cl.
CPC ..... *G03G 15/0825* (2013.01); *G03G 15/086* (2013.01); *G03G 15/0889* (2013.01); *G03G 15/556* (2013.01)
USPC ..... 399/61; 399/27; 399/254

(58) Field of Classification Search
USPC ..... 399/12, 27, 53, 61, 254
See application file for complete search history.

(56) References Cited

U.S. PATENT DOCUMENTS

| | | | | |
|---|---|---|---|---|
| 6,654,566 | B1 | 11/2003 | Yamaguchi et al. | |
| 6,931,216 | B2 * | 8/2005 | Mochizuki et al. | 399/27 |
| 7,218,872 | B2 | 5/2007 | Shimomura | |
| 7,962,057 | B2 * | 6/2011 | Yamamoto et al. | 399/61 |
| 7,991,315 | B2 * | 8/2011 | Kawamura et al. | 399/61 |
| 2005/0260007 | A1 | 11/2005 | Shimomura | |

FOREIGN PATENT DOCUMENTS

| | | | |
|---|---|---|---|
| JP | 2001-56601 | A | 2/2001 |
| JP | 2002-357991 | A | 12/2002 |
| JP | 2005-331726 | A | 12/2005 |
| JP | 2011-95535 | A | 5/2011 |

* cited by examiner

*Primary Examiner* — Sandra Brase
(74) *Attorney, Agent, or Firm* — Fitzpatrick, Cella, Harper & Scinto

(57) ABSTRACT

An image forming apparatus includes an image bearing member for bearing an electrostatic latent image, and a developing device including a container for accommodating the developer, a developer carrying member for carrying the developer and for developing the electrostatic latent image with the developer, a developer supplying member for supplying the developer to the developer carrying member, and stirring member for stirring the developer and for feeding the developer to the developer supplying member. In addition, a controller controls, before image formation, a stirring operation by the stirring member on the basis of information on electrostatic capacity between the developer carrying member and the developer supplying member.

13 Claims, 8 Drawing Sheets

IMAGE FORMING APPARATUS HAVING DEVELOPER STIRRING CONTROL

FIELD OF THE INVENTION AND RELATED ART

The present invention relates to an image forming apparatus, such as a copying machine or a printer, having a function of forming an image on a recording material such as a sheet.

In the image forming apparatus, for the purpose of simplifying replacement of consumables such as an electrophotographic photosensitive member and a developer and simplifying maintenance of the image forming apparatus, there is a process cartridge type in which the electrophotographic photosensitive member and a process means or the like which acts on the electrophotographic photosensitive member are integrally assembled into a process cartridge. This process cartridge is constituted so as to be detachably mountable to an image forming apparatus main assembly. According to the process cartridge type, the maintenance of the image forming apparatus can be performed by a user himself (herself) without relying on a service person, so that operativity of the apparatus can be improved remarkably. Therefore, the cartridge type has been widely used in the electrophotographic image forming apparatus. Further, e.g., in a color image forming apparatus including developing means for a plurality of colors, in the case where the respective developing means are different in degree of consumption, each of developing cartridges each prepared by assembling an associated developing means and a developer container into a cartridge (unit) is detachably mountable to the image forming apparatus and is made individually exchangeable (replaceable) in some cases. Recently, the user replaces the cartridge with a new one in general and there is a possibility that the developer is solidified or localized in one direction depending on a manner of handling, such as a transporting method or a storing method, of the cartridge by the user. For this reason, as an initializing process (initialization) as described in Japanese Laid-Open Patent Application 2001-56601, a constitution in which stirring of the developer is effected has been widely used.

However, in the above conventional constitution, in supplying roller of the brand-new cartridge, the same stirring operation is performed every time although a state of a toner in the cartridge is different depending on the cartridge used. That is, even in the case where short-time supplying roller is enough for the cartridge, the stirring operation is performed for a long time more than necessary in some cases. In these cases, an unnecessary stirring operation is performed, so that there is a possibility that a waiting time of the user becomes long during the replacement of the cartridge with the new one.

SUMMARY OF THE INVENTION

A principal object of the present invention is to provide an image forming apparatus having solved the above problem.

According to an aspect of the present invention, there is provided an image forming apparatus comprising: an image bearing member for bearing an electrostatic latent image; a developing device including a container for accommodating the developer, a developer carrying member for carrying the developer and for developing the electrostatic latent image with the developer, a developer supplying member for supplying the developer to the developer carrying member, and a stirring member for stirring the developer and for feeding the developer to the developer supplying member; and a controller for controlling, before image formation, a stirring operation by the stirring member on the basis of information on electrostatic capacity between the developer carrying member and the developer supplying member.

According to another aspect of the present invention, there is provided an image forming apparatus comprising: a process cartridge, detachably mountable to the image forming apparatus, including an image bearing member for bearing an electrostatic latent image; and a developing device including a container for accommodating the developer, a developer carrying member for carrying the developer and for developing the electrostatic latent image with the developer, a developer supplying member for supplying the developer to the developer carrying member, and a stirring member for stirring the developer and for feeding the developer to the developer supplying member; and a controller for controlling, before image formation, a stirring operation by the stirring member on the basis of information on electrostatic capacity between the developer carrying member and the developer supplying member.

According to a further aspect of the present invention, there is provided an image forming apparatus comprising: an image bearing member for bearing an electrostatic latent image; a developing device including a container for accommodating the developer, a developer carrying member for carrying the developer and for developing the electrostatic latent image with the developer, and a developer supplying member for supplying the developer to the developer carrying member; and a discriminating portion for discriminating whether or not stirring of the developer is needed on the basis of information on electrostatic capacity between the developer carrying member and the developer supplying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

With reference to the drawings, embodiments for carrying out the present invention will be described. However, dimensions, materials, shapes and relative arrangements of constituent elements described in the following embodiments should be appropriately modified depending on constitutions and various conditions of a device (apparatus) to which the present invention is applied. That is, the scope of the present invention is not limited to the following embodiments.

Embodiment 1

Figure 1:
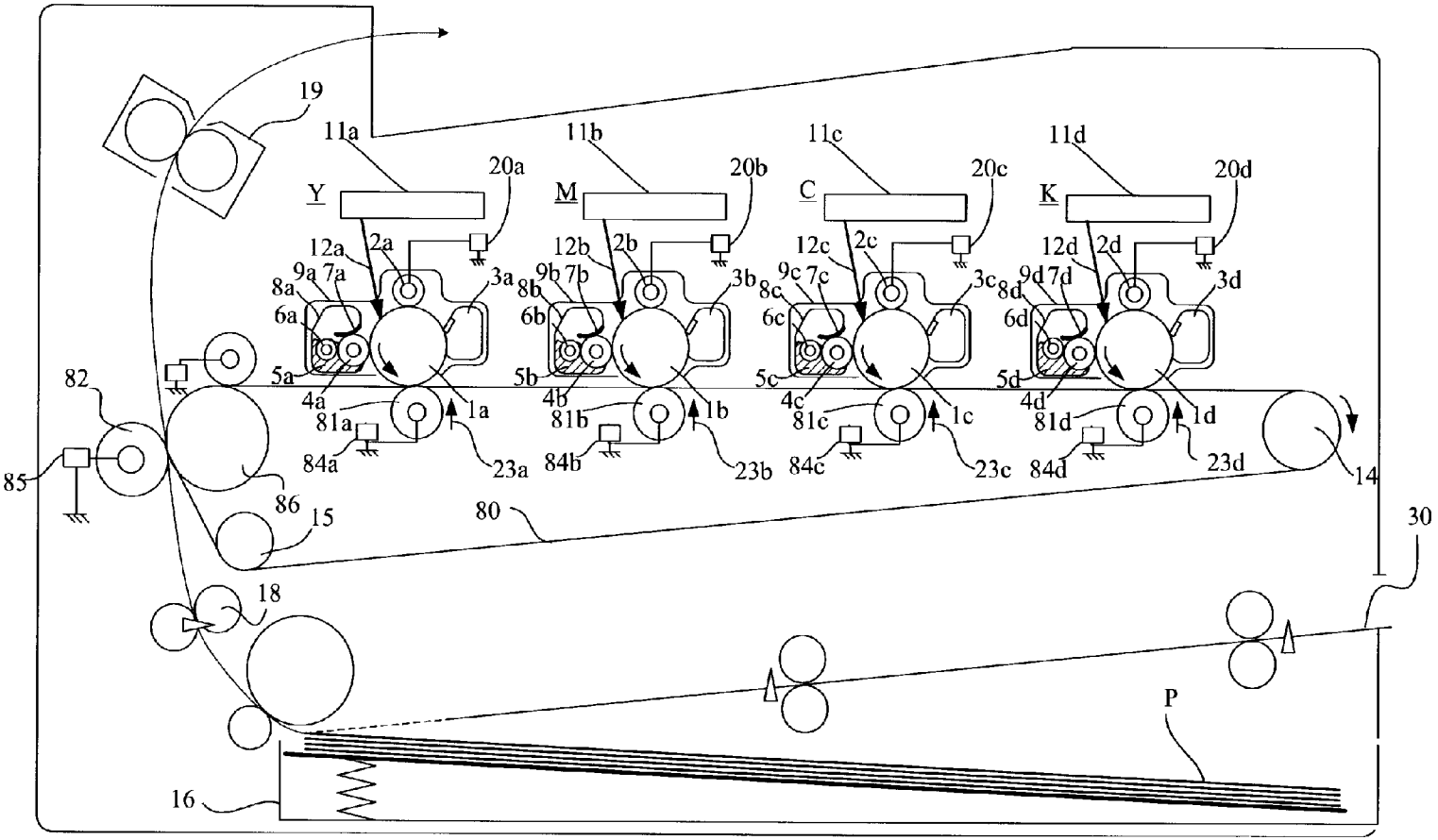
FIG. 1 is a schematic sectional view showing a structure of an image forming apparatus in Embodiment 1.

Embodiment 1 of the present invention will be described. FIG. 1 is a sectional view showing a schematic structure of a laser beam printer as an image forming apparatus in this embodiment.

The image forming apparatus in this embodiment includes a station, as a first station, for forming a toner image of yellow (Y), a station, as a second station, for forming a toner image of magenta (M), a station, as a third station, for forming a toner image of cyan (C), and a station, as a fourth station, for forming a toner image of black (k).

(Image Forming Portion Station)

The first station will be described.

A photosensitive drum (OPC (organic photoconductor (layer)) photosensitive drum in this embodiment) 1*a* as an image bearing member is prepared by laminating, on a cylindrical metal, a plurality of layers of functional organic materials including a carrier generating layer for generating electric charges by being photosensed, a charge transporting layer for transporting the generated electric charges, and the like layer. Here, an outermost layer of the photosensitive drum 1*a* has low electroconductivity and is almost insulative. The photosensitive drum 1*a* is rotatably supported by flanges at its end portions and is rotationally driven in the counterclockwise direction in FIG. 1 by transmitting a driving force from an unshown driving motor to one of the end portions of the photosensitive drum 1*a*.

A charging roller 2*a* as a charging means is an electroconductive roller formed in a roller shape and is provided so as to be rotated in contact with a photosensitive drum surface by rotation of the photosensitive drum 1*a*. To the charging roller 2*a*, a DC voltage or a DC voltage biased with an AC voltage is applied, so that the photosensitive drum 1*a* is electrically charged uniformly by generation of electric discharge in minute air gaps in upstream and downstream sides of a contact nip between the charging roller 2*a* and the photosensitive drum surface.

A developing unit 8*a* as a developing means includes a developing roller 4*a*, a non-magnetic one-component developer (toner) 5*a* and a developer applying blade 7*a*. Further, by a mechanism, for feeding the toner, provided in a developing container, the toner is sent to a supplying roller 6*a*. Then, by a supply roller 6*a* and the developer applying blade 7*a* press-contacted to an outer peripheral surface of the developing roller 4*a*, the toner 5*a* is applied in a thin layer onto the outer peripheral surface of the developing roller 4*a* rotating in the clockwise direction in FIG. 1, and the electric charges are imparted to the toner (triboelectric charge).

Here, the developing roller 4*a* corresponds to a developer carrying member for developing an electrostatic latent image formed on the photosensitive drum 1*a*, and the supplying roller 6*a* corresponds to a developer supplying member for supplying the toner to the developing roller 4*a*.

The photosensitive drum 1*a*, the charging roller 2*a*, a cleaning unit 3*a* and the developing unit 8*a* (the developing roller 4*a*, the toner 5*a*, the supplying roller 6*a* and the developer applying blade 7*a*) are constituted as an integral type process cartridge 9*a* which is detachably mountable to an image forming apparatus main assembly. Here, the cleaning unit 3*a* is used for removing a transfer residual toner on the photosensitive drum 1*a*. Further, the process cartridge 9*a* corresponds to a cartridge and is not limited to that constituted as described above. That is, a cartridge in which at least the developing unit 8*a* of the photosensitive drum 1*a*, the charging roller 2*a*, the cleaning unit 3*a* and the developing unit 8 may only be required to be constituted so as to be detachably mountable to the image forming apparatus main assembly.

Further, an exposure means 11*a* is constituted by a scanner unit for scanning the photosensitive drum surface with laser light through a rotatable polygonal mirror or by an LED array and irradiates the surface of the photosensitive drum 1*a* with a laser beam 12*a* modulated on the basis of an image signal.

Further, the charging roller 2*a* and a primary transfer roller 81*a* are connected to a charging bias voltage source 20*a* as a voltage supplying means to the charging roller 2*a* and a primary transfer bias voltage source 84*a* as a voltage supplying means to the primary transfer roller 81*a*, respectively.

The constitution of the first station is as described above. Also the second to fourth stations have the same constitution as the first station and therefore will not be described in individual detail. Of course, each stations includes a charging roller (2*b*, 2*c*, 2*d*), a cleaning unit (3*b*, 3*c*, 3*d*), a developing roller (4*b*, 4*c*, 4*d*), toner (5*b*, 5*c*, 5*d*), a supply roller (6*b*, 6*c*, 6*d*), a developer applying blade (7*b*, 7*c*, 7*d*), a developing unit (8*b*, 8*c*, 8*d*), and a process cartridge (9*b*, 9*c*, 9*d*). Additionally, each station includes its own exposure means (11*b*, 11*c*, 11*d*), laser beam (12*b*, 12*c*, 12), and voltage source (20*b*, 20*c*, 20*d*).

An intermediary transfer belt 80 is supported by three rollers, as its stretching member, consisting of a secondary transfer opposite roller 86, a driving roller 14 and a tension roller 15, and is constituted so as to maintain an appropriate tension. The intermediary transfer belt 80 is provided so that its outer peripheral surface contacts all four photosensitive drums 1*a* to 1*d*, and the photosensitive drums 1*a* to 1*d* are juxtaposed along a rotational direction of the intermediary transfer belt 13. By driving the driving roller 14, the intermediary transfer belt 80 is moved at the substantially same speed as those of the photosensitive drums 1*a* to 1*d* in the same direction as those (arrow directions) of the develops 1*a* to 1*d*.

Further, inside the intermediary transfer belt 80, at opposing positions to the photosensitive drums 1*a* to 1*d*, primary transfer rollers 81*a* to 81*d* contacting the intermediary transfer belt 80 are provided. As a result, primary transfer portions (contact portions or nips) are formed by the belt, the photosensitive drums 1*a* to 1*d*, and the primary transfer rollers 81*a* to 81*d*, respectively. Further, in the downstream side of the primary transfer rollers 81*a* to 81*d* with respect to the rotational direction of the intermediary transfer belt 80, (electric) discharging members 23*a* to 23*d* are provided. The driving roller 14, the tension roller 15, the discharging members 23*a* to 23*d*, and a secondary transfer opposite roller 86 are electrically grounded.

Further, when an electrostatic latent image is formed on each photosensitive drum 1 by the light exposure from each exposure means 11*a*, 11*b*, 11*c* and 11*d*, a voltage of a polarity opposite to that of the toner is applied to each primary transfer roller 81 from each primary transfer bias voltage source 84. As a result, the toner images formed on the respective photosensitive drums 1 are successively primary-transferred superposedly onto the intermediary transfer belt 80, so that a multiple image (multiple toner image) is formed on the intermediary transfer belt 80.

Here, the constitutions and operations of the respective process cartridges are substantially same except that the colors of the toners used are different from each other. Accordingly, in the following description, in the case where constituent elements are not particularly required to be differentiated from each other, suffixes a to d added for representing the constituent elements provided for the respective colors in FIG. 1 will be omitted and collectively described.

(Sheet Conveyance)

A sheet P as a recording material fed from a feeding portion (cassette 16 or manual feeding portion 30) is conveyed by a registration roller 18 to a secondary transfer portion which is a contact portion between a secondary transfer roller 82 and the intermediary transfer belt 80. On the other hand, the multi-color image formed (electrostatically attracted) on the outer peripheral surface of the intermediary transfer belt 80 is conveyed to the secondary transfer portion by circulation movement of the intermediary transfer belt 80 caused by the rotation of the driving roller 14. Thereafter, to the secondary transfer roller 82, a voltage of a polarity opposite to that of the toner is applied from a secondary transfer bias voltage source 85, so that the four color-based multiple image carried on the intermediary transfer belt 80 is secondary-transferred collectively onto the sheet P at the secondary transfer portion.

Here, with respect to sheet conveyance, an electric field is formed, by applying the voltage to the secondary transfer roller 82, on the secondary transfer opposite roller 86, so that dielectric polarization is generated between the intermediary transfer belt 80 and the sheet to generate an electrostatic attraction force between the intermediary transfer belt 80 and the sheet.

(Fixing Portion)

A fixing means 19 fixes the toner image on the sheet P by applying heat and pressure to the toner image formed on the sheet P, and includes an unshown fixing belt and an unshown elastic pressing roller. The elastic pressing roller sandwiches the fixing belt between itself and an unshown belt guide member to form a fixing nip with a predetermined width under application of a predetermined press-contact force between the elastic pressing roller and the belt guide portion.

In a state of the nip increased in temperature up to a predetermined temperature and being temperature-controlled at the predetermined temperature, the sheet P on which an unfixed toner image conveyed from the image forming portion is introduced between the fixing belt and the elastic pressing roller at the fixing nip so that an image surface opposes a fixing belt surface. The sheet P introduced into the fixing nip is nipped and conveyed at the fixing nip together with the fixing belt in a state in which the image surface is closely contacted to the outer peripheral surface of the fixing belt. In a process in which the sheet P is nipped and conveyed together with the fixing belt at the fixing nip, the toner image formed on the sheet P is heated and pressed by the fixing belt, so that the unfixed toner image on the sheet P is fixed on the sheet P.

Figure 2:
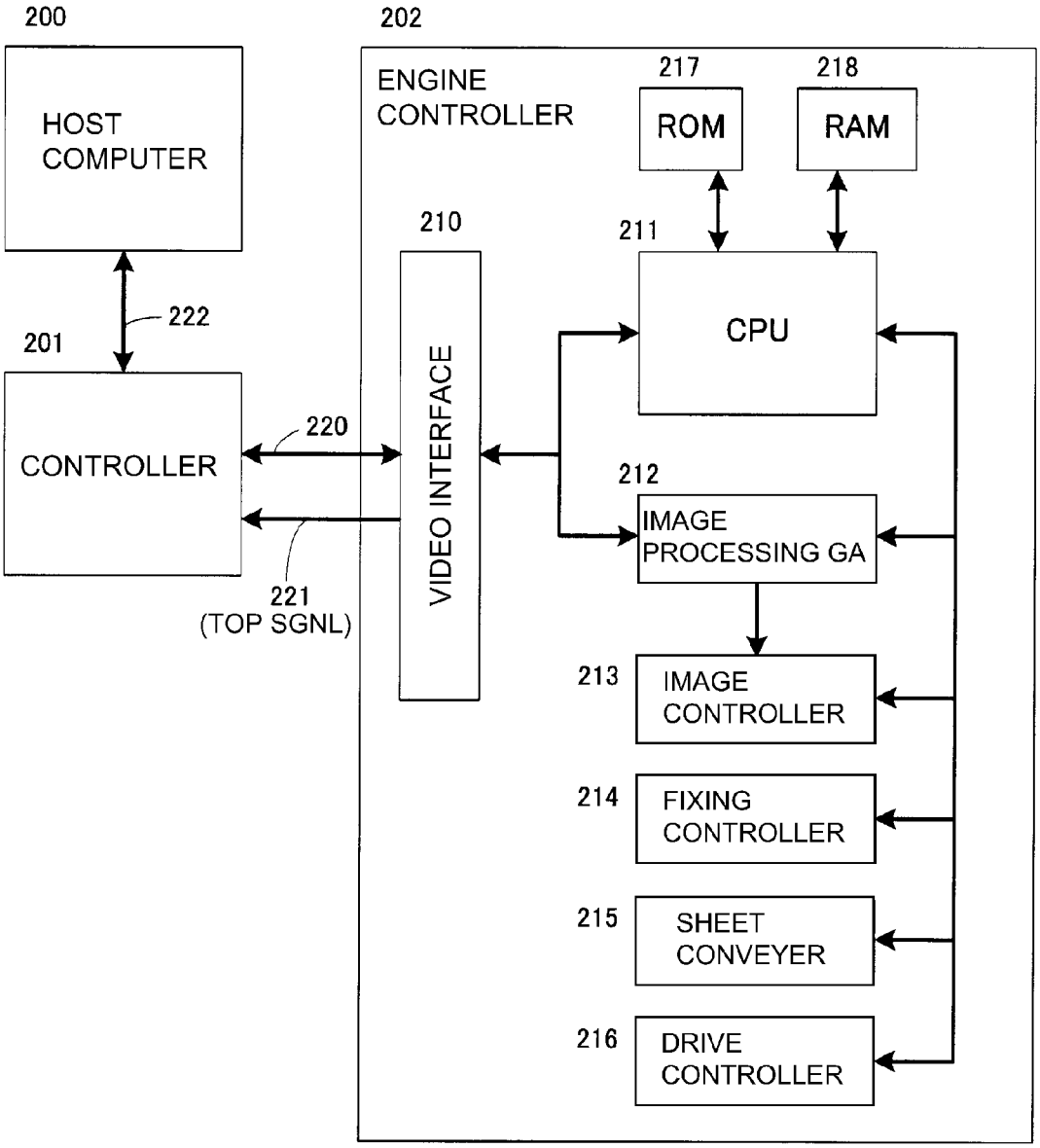
FIG. 2 is a block diagram for illustrating a schematic system constitution of the image forming apparatus in Embodiment 1.

FIG. 2 is a block diagram for illustrating a schematic system constitution of the image forming apparatus in this embodiment.

A controller (control portion) 201 is capable of communicating with a host computer 200 and an engine controller 202 as shown by arrows 220 and 222, respectively, in FIG. 2.

The controller 201 receives image information and a printing (image forming) condition from the host computer 200. The controller 201 sends a print-reserving command for making reservation of a printing operation, to which printing information for each sheet is added, on the basis of the received printing condition, and then analyzes the received image information and converts the image information into bit data. Here, the printing information for each sheet refers to, e.g., a feeding port (feeding cassette), a sheet size, a printing mode and the like.

The controller 201 sends, at the time when the analyzation of the image information is ended, a print start command for providing the engine controller 202 with instructions to start the printing operation. The engine controller 202 outputs, when it receives the print start command, a TOP signal 221 at timing which constitutes reference timing of output of a video signal to the first station as a yellow image forming portion. Then, a feeding operation is started, and the fed sheet P is placed temporarily in a stand-by state by the registration roller 18. Thereafter, in synchronism with reaching of the toner image formed of the intermediary transfer belt 80 at the secondary transfer portion, the sheet P is fed from the registration roller 18. Incidentally, the engine controller 202 includes a video interface portion 210, CPU 211, image processing GA 212, an image controller 213, a fixing controller 214, a sheet conveying portion 215, a drive controller 216, ROM 217 for storing a program, and RAM 218 which enables reading/writing of information.

Figure 3:
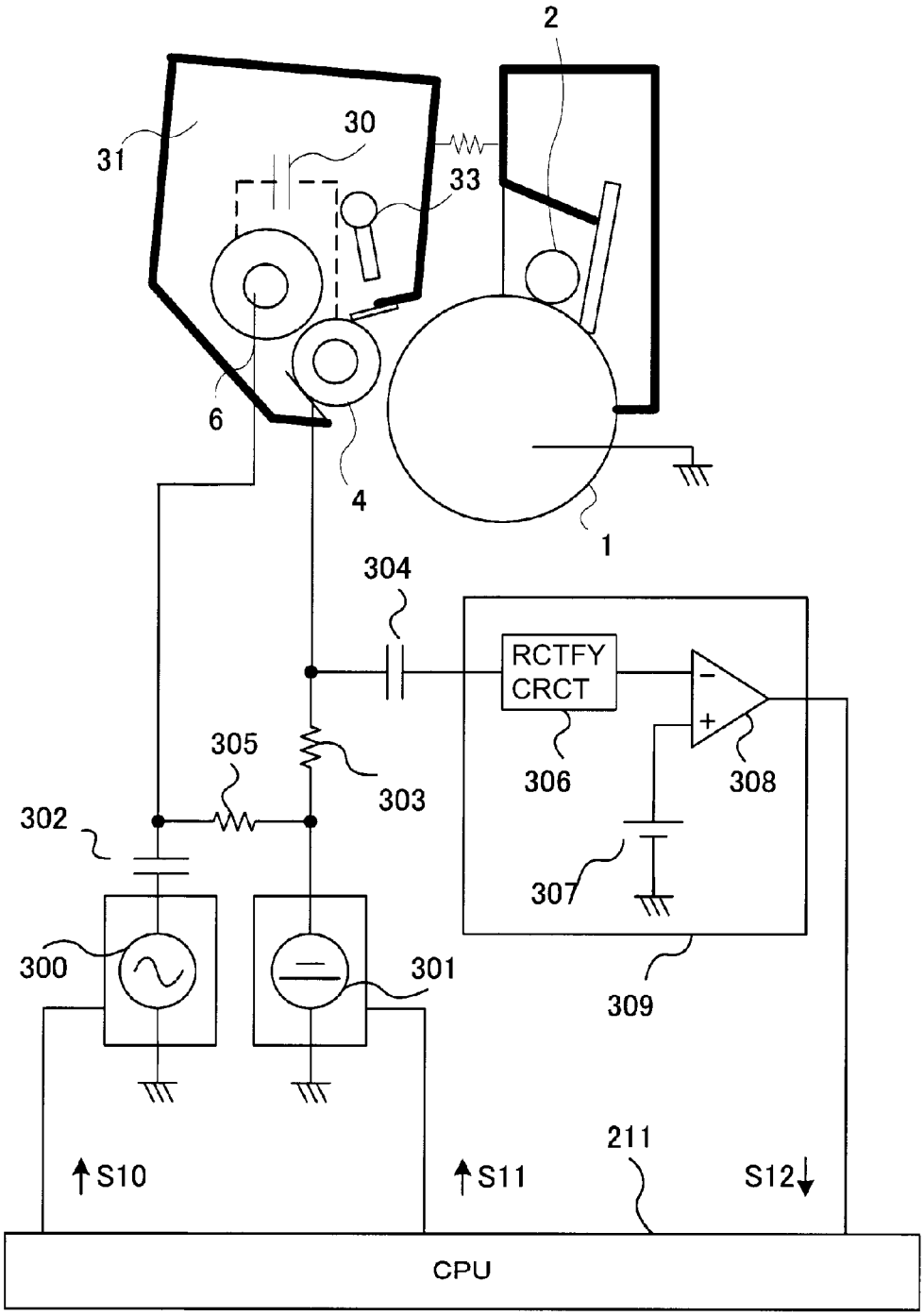
FIG. 3 is a schematic view showing a structure of a remaining toner amount detecting mechanism of an electrostatic capacity detecting type in Embodiment 1.

FIG. 3 is a schematic illustration of a remaining toner amount detecting mechanism of an electrostatic capacity detecting type in this embodiment.

In this embodiment, the developing roller 4 is used as an antenna, and then a remaining toner amount is detected from a change in electrostatic capacity of an equivalent capacitor 30 formed between the developing roller 4 and the supplying roller 6. Then, a toner stirring means (stirring member) 33 effects stirring of the toner, as initialization (initialization processing) of the process cartridge 9, in order to supply the toner to the supplying roller 6 and the developing roller 4. Here, the toner stirring means 33 corresponds to an initialization means for executing the initialization for placing the image forming apparatus in an image formation start enable state by supplying the toner to the developing roller 4 and the supplying roller 6 depending on a discrimination result of a discriminating means described later to increase a toner amount between the developing roller 4 and the supplying roller 6. The initialization means is not limited to the toner stirring means but may only be required to increase the toner amount between the developing roller 4 and the supplying roller 6 (e.g., the toner is supplied (moved) between the developing roller 4 and the supplying roller 6 by vibration). In the image forming apparatus in this embodiment, a contact developing type using a DC voltage source for applying the developing bias is employed.

In this embodiment, an AC voltage source 300 for applying a voltage to the supplying roller 6 is electrically connected to the supplying roller 6 so that an electrostatic capacity of the equivalent capacitor 30. The AC voltage depending on a signal S10 from the CPU 211 is applied to the supplying roller 6. Incidentally, a capacitor 302 and a resistor 305 constitute a circuit for separating a voltage so that the influence of the voltage when the voltage is applied to the AC voltage source 300 is not exerted on the remaining toner amount detecting circuit. Here, the AC voltage source 300 corresponds to a potential difference generating means for generating a potential difference between the developing roller 4 and the supplying roller 6.

As the toner in the toner container 31 is gradually consumed, the toner amount between the developing roller 4 and the supplying roller 6 is decreased, so that dielectric constant between the developing roller 4 and the supplying roller 6 is decreased and thus a resultant electrostatic capacity becomes small. By detecting a change of this electrostatic capacity, a remaining toner amount in the toner container can be detected.

That is, when a predetermined AC voltage is applied from the AC voltage source to the supplying roller 6, an AC current value depending on the electrostatic capacity of the equivalent capacitor 30 formed between the developing roller 4 and the supplying roller 6 is obtained. This AC current value is converted into a voltage by being rectified by a rectifying circuit 306, and a voltage difference between the voltage and a reference voltage 307 is amplified by an operational amplifier 308 and is inputted, as an analog signal S12 which is a remaining toner amount detection result, into the CPU 211. Thereafter, the signal S12 is subjected to A/D conversion, thus being converted into a detected current value which is a digital value.

To the developing roller 4, a high-DC voltage depending on a signal S11 from the CPU 211 is applied. To the developing roller 4, a DC voltage source 301 for high voltage and a remaining toner amount detecting circuit 309 for low voltage are connected, and therefore a resistor 303 and a capacitor 304 which are used for separating these circuits are provided. Here, the remaining toner amount detecting circuit 309 constituted by the rectifying circuit 306, the reference voltage 307, and the operational amplifier 30, and the CPU 211 correspond to a detecting means for detecting the electrostatic capacity between the developing roller 4 and the supplying roller 6.

Figure 4:
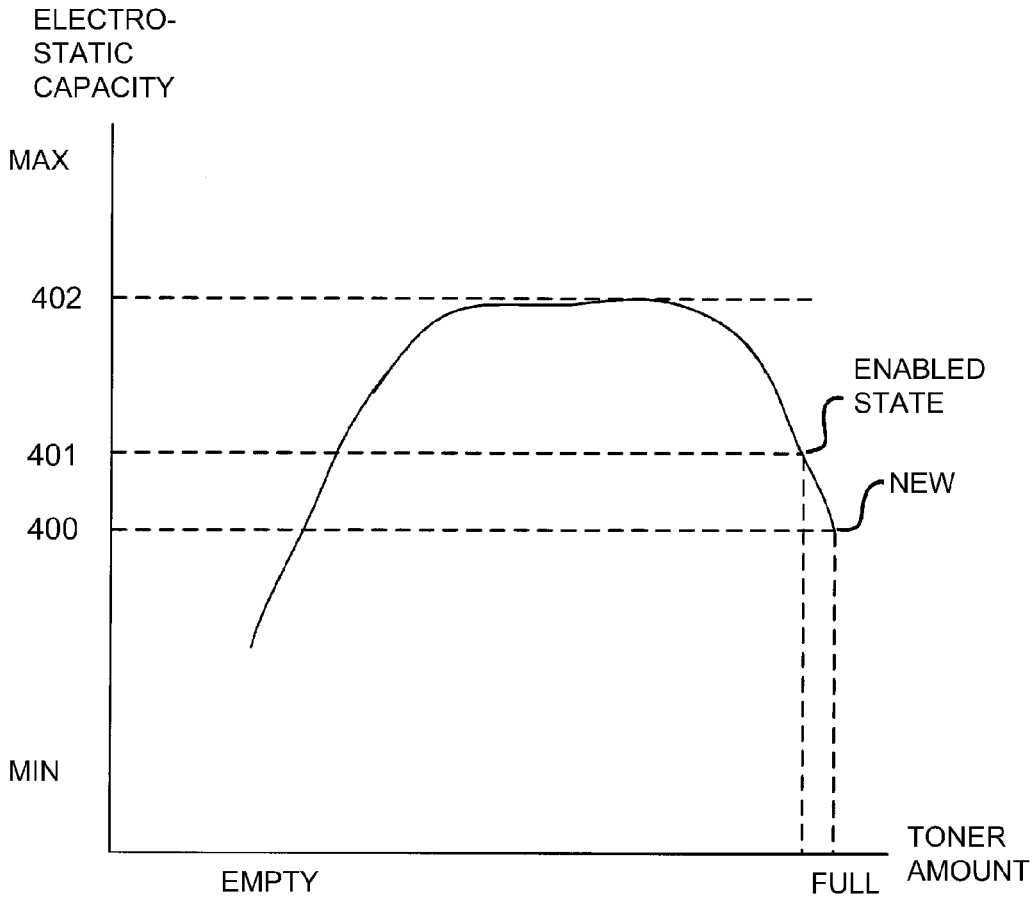
FIG. 4 is a graph showing a relationship between a toner amount and electrostatic capacity in Embodiment 1.

FIG. 4 is a graph showing a relationship between the electrostatic capacity and the toner amount detected by using the remaining toner amount detecting mechanism of the electrostatic capacity detecting type shown in FIG. 3.

A value of the electrostatic capacity between the developing roller 4 and the supplying roller 6 is influenced by an amount of the toner which enters between these rollers. At the time immediately after the start of use of the toner, the toner does not sufficiently enter between the developing roller 4 and the supplying roller 6. For that reason, a brand-new state electrostatic capacity 400 to be detected shows a smaller value than an actual value although the toner is in a full state, i.e., is filled up. When the toner in the toner container is stirred from that state, the toner enters between the developing roller 4 and the supplying roller 6, so that the electrostatic capacity between the developing roller 4 and the supplying roller 6 becomes large.

Thereafter, an image forming operation (image formation) is performed and thus the gap between the developing roller 4 and the supplying roller 6 is gradually filled with the toner, so that the electrostatic capacity reaches the neighborhood of a maximum electrostatic capacity value 402 when the gap is substantially filled with the toner.

In the case where there is a sufficient amount of the toner in the toner container, the electrostatic capacity is kept as it is for a while, and when the image forming operation is continued and thus the amount of the toner in the toner container is decreased, the amount of the toner between the developing roller 4 and the supplying roller 6 is also decreased and thus also the electrostatic capacity becomes small.

Therefore, the electrostatic capacity between the developing roller 4 and the supplying roller 6 shows a change as shown in FIG. 4 in a period from immediately after the start of use of the process cartridge until the toner becomes empty. By using such a characteristic, the toner in a minimum necessary amount (image formation start enable amount) in which an image defect due to insufficient stirring is not generated is caused to enter between the developing roller 4 and the supplying roller 6, so that an image formation start enable state is created, and the electrostatic capacity at that time is a stirring end state electrostatic capacity 401.

Figure 5:
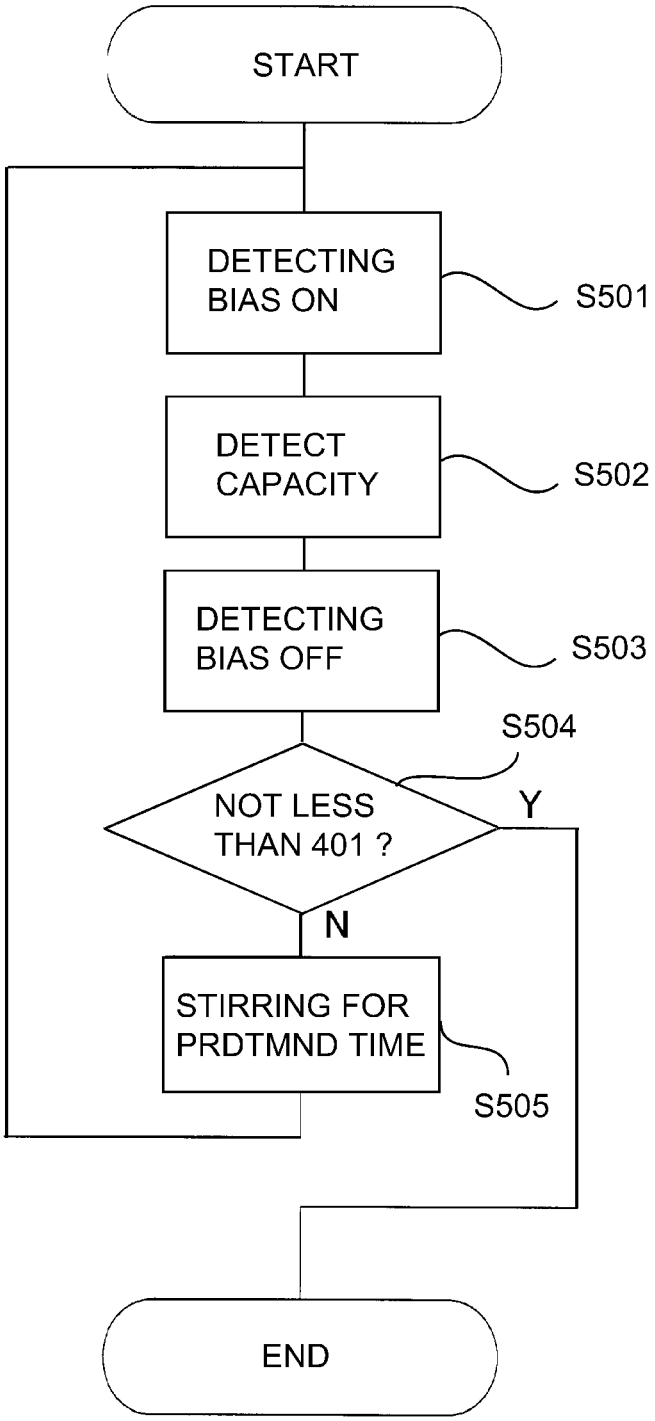
FIG. 5 is a flow chart for illustrating stirring end discrimination in Embodiment 1.

FIG. 5 is a flow chart for illustrating stirring end discrimination of a brand-new process cartridge, by using the stirring end state electrostatic capacity shown in FIG. 4, executed by the engine controller 202. This flow chart is started in the case where the process cartridge 9 is discriminated as being a brand-new article when the process cartridge 9 is mounted in the image forming apparatus main assembly. Further, in the case where there are a plurality of brand-new process cartridges, the processing may be sequentially effected for every cartridge or effected in parallel.

The discrimination as to whether or not the process cartridge is the brand-new article is enabled by storing information of the brand-new article in a storing means provided to the process cartridge and by constituting the information so as to be capable of being read and written in the image forming apparatus main assembly side. Further, as the brand-new process cartridge in this embodiment, a process cartridge in an unused state, i.e., a process cartridge, in a state in which the toner filled in the toner container (toner accommodating chamber) is not consumed, such as a reproduced process cartridge is included. Here, the engine controller 202 constitutes a discriminating means (discriminating portion) and a control means.

The engine controller 202 turns on an AC remaining amount detecting bias (S501) and effects detection of the electrostatic capacity between the developing roller 4 and the supplying roller 6 by the procedure described with reference to FIG. 4 (S502). When the detection is ended, the remaining amount detecting bias is turned off (S503). By comparing a current value detected in S502 with a value (threshold) of the stirring end state electrostatic capacity 401, discrimination as to whether or not stirring is sufficiently made (discrimination as to whether or not the toner amount between the developing roller 4 and the supplying roller 6 is an image formation start enable amount) is effected (S504).

In the case where the detected current value is smaller than the value of the stirring end state electrostatic capacity 401 (No of S504), discrimination that the toner is not yet stirred sufficiently is made (negative discrimination), so that stirring for a predetermined time is made as initialization by the toner stirring means 33 (S505). When the stirring is ended, the processing is effected again from S501. On the other hand, in the case where the detected current value is not less than the value (threshold) of the stirring end state electrostatic capacity 401 (Yes of S504), discrimination that the toner is sufficiently stirred is made (positive discrimination), and then the flow chart is ended (the initialization is terminated).

As described above, in this embodiment, the end of the stirring is discriminated by the electrostatic capacity, at the time of the end of the stirring, measured in advance. That is, before the image formation, the stirring operation by the toner stirring means 33 is controlled on the basis of the information on the electrostatic capacity between the developing roller 4 and the supplying roller 6. As a result, the toner stirring state (state (amount)) of the toner accommodated in the toner container) can be detected (grasped or presumed) for each process cartridge, so that necessary minimum stirring with no waste can be effected for each process cartridge. Accordingly, optimum initialization can be performed every process cartridge, so that a time required to perform the initialization at the time of mounting the brand-new process cartridge can be minimized every process cartridge. Further, for each process cartridge, the initialization can be performed for only a necessary time depending on the toner state and therefore compared with the case where the initialization is performed uniformly for the certain time as in the conventional constitution, it is possible to shorten a time required to mount the brand-new cartridge. That is, a waiting time of the user when the brand-new cartridge is mounted can be reduced, so that convenience of the user can be improved.

Here, in this embodiment, the detection of the electrostatic capacity and the stirring of the toner are separately performed, but it is possible the stirring of the toner can be performed while detecting the electrostatic capacity.

Embodiment 2

In the following, Embodiment 2 will be described.

Also in this embodiment, similarly as in Embodiment 1, discrimination of the stirring end is effected by using the relationship, shown in FIG. 4, between the electrostatic capacity and the toner amount obtained by using the remaining toner amount detecting mechanism of the electrostatic capacity detecting type. In Embodiment 1, the electrostatic capacity was set in advance for discriminating the end of the stirring by an absolute amount of the toner as the toner state between the developing roller 4 and the supplying roller 6. On the other hand, in this embodiment, stirring end discrimination is made by an increment of the amount of the toner between the developing roller 4 and the supplying roller 6, i.e., an increment of the electrostatic capacity. That is, the engine controller 202 executes the stirring operation until the electrostatic capacity is increased by a predetermined amount or more. In the case where the toner tends to be solidified, the stirring end discrimination can be made early when the discrimination is made on the basis of the increment of the toner between the developing roller 4 and the supplying roller 6. This is because even before the electrostatic capacity reaches the electrostatic capacity set in advance as in Embodiment 1, when the increment of the toner between the developing roller 4 and the supplying roller 6 is increased, it is understood that the toner is being gradually stirred sufficiently. At that stage, the end of the stirring operation is discriminated. Incidentally, in this embodiment, constituent elements or portions similar to those in Embodiment 1 are represented by the same reference numerals or symbols and will be omitted from description.

Figure 6:
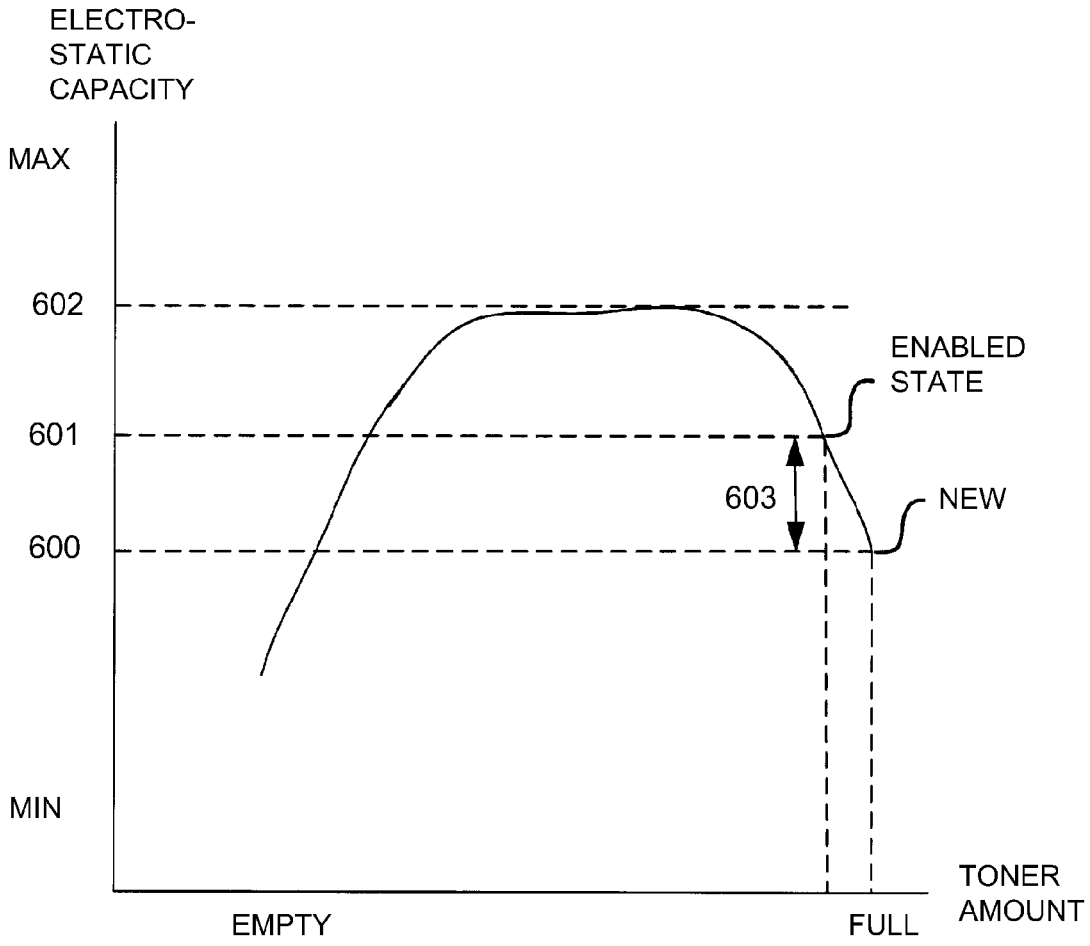
FIG. 6 is a graph showing a relationship between a toner increment and electrostatic capacity in Embodiment 2.

FIG. 6 is a graph showing a relationship between the toner increment and the electrostatic capacity detected by using the remaining toner amount detecting mechanism of the electrostatic capacity detecting type shown in FIG. 3. In FIG. 6, an increment of the electrostatic capacity corresponding to an increment of the toner caused to enter between the developing roller 4 and the supplying roller 6 in order to place the image forming apparatus in an image formation start enable state in which an image defect due to insufficient stirring is not generated is a stirring end state electrostatic capacity increment 603. Incidentally, electrostatic capacitors 600 to 602 in FIG. 6 are the same as those 400 to 402 in FIG. 3, respectively.

Figure 7:
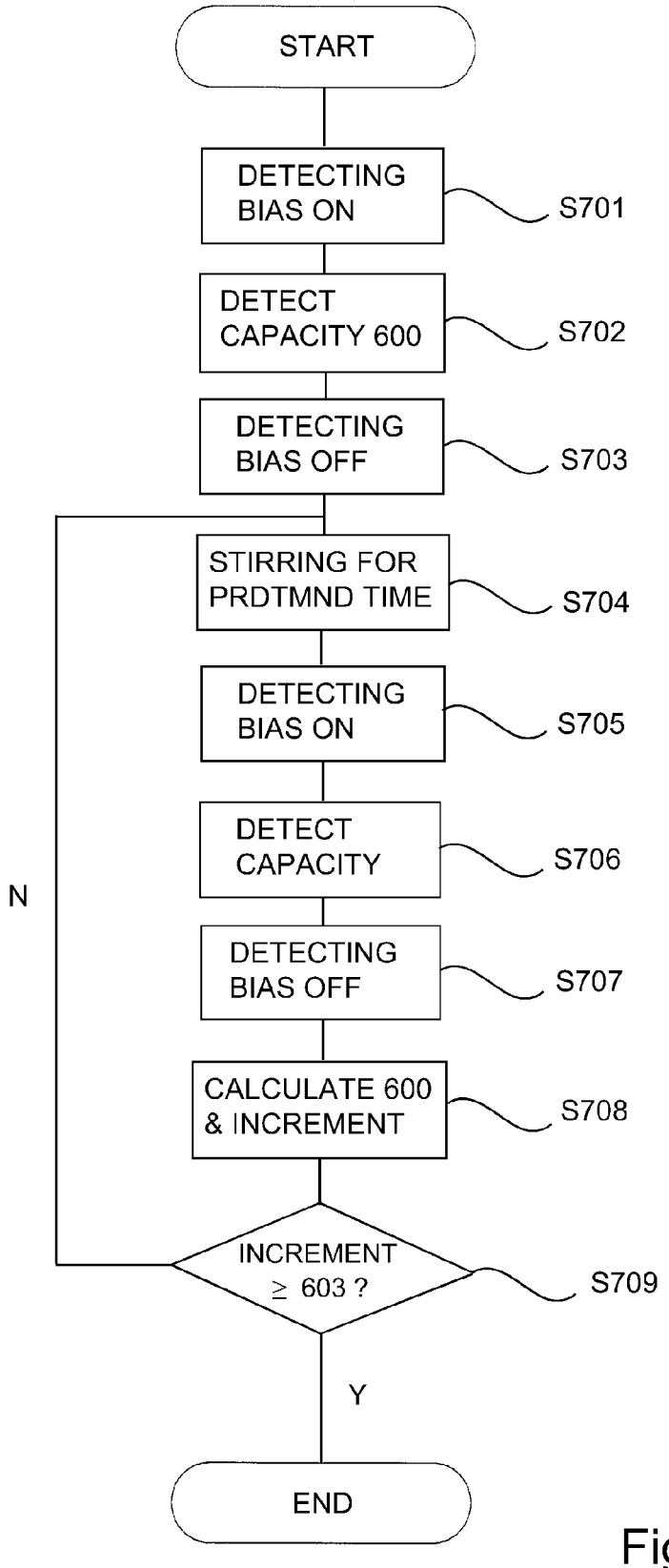
FIG. 7 is a flow chart for illustrating stirring end discrimination in Embodiment 2.

FIG. 7 is a flow chart for illustrating stirring end discrimination of a brand-new process cartridge by using the stirring end state electrostatic capacity increment in FIG. 6. Also in this flow chart, the stirring end discrimination is started at the time when the process cartridge 9 is discriminated as a brand-new article when the process cartridge 9 is mounted in the image forming apparatus main assembly. The engine controller 202 turns on the AC remaining amount detecting bias (S701), and then detects the brand-new state electrostatic capacity 600 by the procedure described with reference to FIG. 4 (S702). Here, the brand-new state electrostatic capacity 600 corresponds to a value of the electrostatic capacity first detected when the brand-new process cartridge 9 is mounted in the image forming apparatus main assembly.

When the detection is ended, the remaining amount detecting bias is turned off (S703). The toner is stirred for a predetermined time by the stirring means in order to cause the toner to enter between the developing roller 4 and the supplying roller 6 (S704). In S705, similarly as in S701, the detecting bias is turned on. In S706, similarly as in S702, the detection of the electrostatic capacity after the stirring is made. In S707, similarly as in S703, the detecting bias is turned off.

Then, the electrostatic capacity increment as a difference between the brand-new state electrostatic capacity 600 detected in S702 and the electrostatic capacity detected after the stirring in S706 is calculated by the engine controller 202 (S708). In S709, the electrostatic capacity increment calculated in S708 and the stirring end state electrostatic capacity increment 603 (FIG. 6) are compared with each other. In the case where the electrostatic capacity increment calculated in S708 is not less than the stirring end state electrostatic capacity increment (threshold) 603 (Yes of S709), the toner is discriminated as being stirred sufficiently, so that the flow chart is ended. On the other hand, in the case where the calculated electrostatic capacity increment is discriminated as being smaller than the stirring end state electrostatic capacity increment 603 (No of S709), the toner is stirred again in S704 and then the similar processing is continued until the calculated electrostatic capacity increment is not less than the stirring end state electrostatic capacity increment 603.

As described above, in this embodiment, a constitution in which the end of the stirring is discriminated by a change amount of the electrostatic capacity, measured in advance, until the stirring end is employed. As a result, it becomes possible to obtain an effect similar to that in Embodiment 1.

Embodiment 3

In the following, Embodiment 3 will be described. In this embodiment, a constitution in which the stirring means provided with the constitution in Embodiment 1 is not provided in the image forming apparatus main assembly or the process cartridge, and there is a need for the user to stir the toner at the time of start of use of the brand-new process cartridge.

Also in this embodiment, similarly as in Embodiment 1, discrimination of the stirring end of the toner is effected by using the relationship, shown in FIG. 4, between the electrostatic capacity and the toner amount obtained by using the remaining toner amount detecting mechanism of the electrostatic capacity detecting type. Incidentally, in this embodiment, constituent elements or portions similar to those in Embodiment 1 are represented by the same reference numerals or symbols and will be omitted from description.

Figure 8:
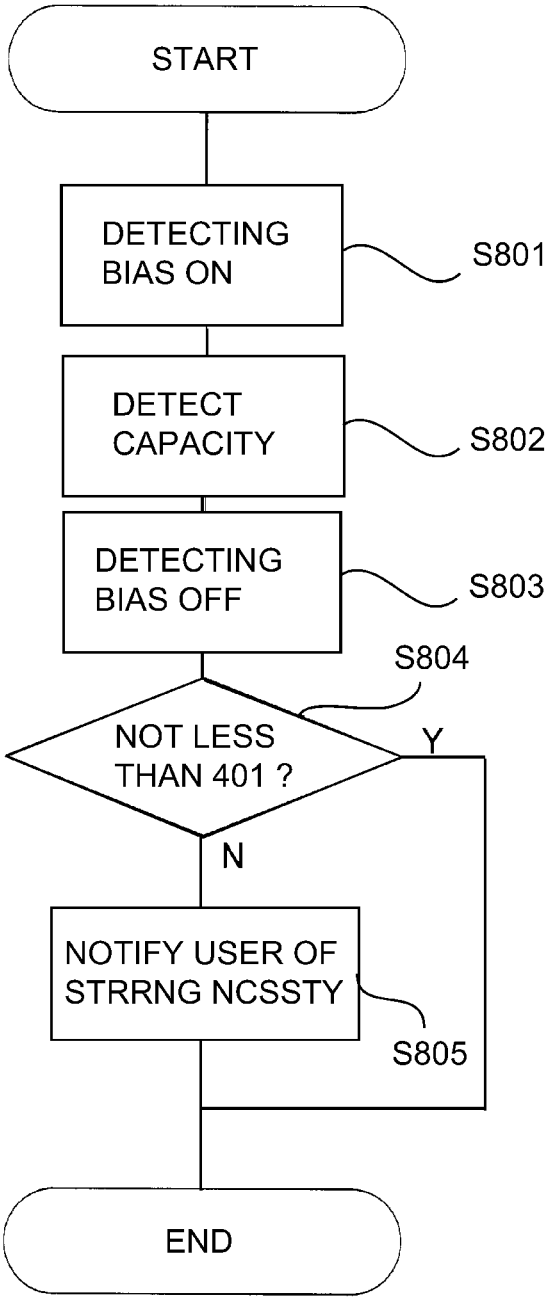
FIG. 8 is a flow chart for illustrating stirring end discrimination in Embodiment 3.

FIG. 8 is a flow chart for illustrating stirring end discrimination of a brand-new process cartridge by the user by using the stirring end state electrostatic capacity shown in FIG. 4. Also in this flow chart, the stirring end discrimination is started at the time when the process cartridge 9 is discriminated as a brand-new article when the process cartridge 9 is mounted in the image forming apparatus main assembly. The engine controller 202 turns on the AC remaining amount detecting bias (S801), and then detects the electrostatic capacity between the developing roller 4 and the supplying roller 6 by the procedure described with reference to FIG. 4 (S802). When the detection is ended, the remaining amount detecting bias is turned off (S803). By making comparison between the current value detected in S802 and the stirring end state electrostatic capacity 401, discrimination as to whether or not the toner is sufficiently stirred is made (S804). In the case where the detected current value is smaller than the stirring end state electrostatic capacity 401 (No of S804), the toner is discriminated as being not sufficiently stirred, and a notifying means notifies the user of necessity of the stirring (S805). With respect to a notifying method to the user, information indicating the necessity of the stirring may be displayed at a displaying portion (not shown) provided on the image forming apparatus main assembly or may also be sent to an external device such as a computer connected to the image forming apparatus main assembly to provide the user with warning.

Then, in the case where a door which is provided to the image forming apparatus main assembly and which is opened and closed when the process cartridge 9 is demounted and the brand-new process cartridge 9 is mounted is opened and closed, the flow chart is started and then whether or not the stirring of the toner by the user is made. That is, whether or not the detected current value is larger than the stirring end state electrostatic capacity 401 is detected. In the case where the detected current value is not less than the stirring end state electrostatic capacity 401 (Yes of S804), the toner is discriminated as being stirred sufficiently, so that the flow chart is ended.

As described above, in this embodiment, even in a constitution in which the stirring of the toner in the brand-new process cartridge is made by the user, the end of the stirring is discriminated by a change amount of the electrostatic capacity, measured in advance, until the stirring end. As a result, it becomes to obtain an effect similar to that in Embodiment 1.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 043947/2012 filed Feb. 29, 2012, which is hereby incorporated by reference.

What is claimed is:

1. An image forming apparatus comprising:

an image bearing member for bearing an electrostatic latent image;

a developing device including a container for accommodating the developer, a developer carrying member for carrying the developer and for developing the electrostatic latent image with the developer, a developer supplying member for supplying the developer to said developer carrying member, and a stirring member for stirring the developer and for feeding the developer to said developer supplying member; and a controller for controlling, before image formation, a stirring operation by said stirring member on the basis of information on electrostatic capacity between said developer carrying member and said developer supplying member.

2. An apparatus according to claim 1, wherein said controller executes the stirring operation on the basis of information that the electrostatic capacity is less than a threshold.

3. An apparatus according to claim 1, wherein said controller does not execute the stirring operation when the electrostatic capacity is not less than a threshold.

4. An apparatus according to claim 1, wherein said controller executes the stirring operation until the electrostatic capacity is increased in a predetermined amount or more.

5. An apparatus according to claim 1, wherein when said developing device is a new article, said controller controls, before image formation is started by using said developing device, the stirring operation on the basis of the information on the electrostatic capacity between said developer carrying member and said developer supplying member.

6. An image forming apparatus comprising:

a process cartridge, detachably mountable to said image forming apparatus, including an image bearing member for bearing an electrostatic latent image; and a developing device including a container for accommodating the developer, a developer carrying member for carrying the developer and for developing the electrostatic latent image with the developer, a developer supplying member for supplying the developer to said developer carrying member, and a stirring member for stirring the developer and for feeding the developer to said developer supplying member; and a controller for controlling, before image formation, a stirring operation by said stirring member on the basis of information on electrostatic capacity between said developer carrying member and said developer supplying member.

7. An apparatus according to claim 6, wherein said controller executes the stirring operation on the basis of information that the electrostatic capacity is less than a threshold.

8. An apparatus according to claim 6, wherein said controller does not execute the stirring operation when the electrostatic capacity is not less than a threshold.

9. An apparatus according to claim 6, wherein said controller executes the stirring operation until the electrostatic capacity is increased in a predetermined amount or more.

10. An apparatus according to claim 6, wherein when said developing device is a new article, said controller controls, before image formation is started by using said developing device, the stirring operation on the basis of the information on the electrostatic capacity between said developer carrying member and said developer supplying member.

11. An image forming apparatus comprising:

an image bearing member for bearing an electrostatic latent image;

a developing device including a container for accommodating the developer, a developer carrying member for carrying the developer and for developing the electrostatic latent image with the developer, and a developer supplying member for supplying the developer to said developer carrying member; and a discriminating portion for discriminating whether or not stirring of the developer is needed on the basis of information on electrostatic capacity between said developer carrying member and said developer supplying member.

12. An apparatus according to claim 11, further comprising a notifying portion for notifying, when said discriminating portion discriminates that the stirring of the developer is needed, information indicating that the stirring of the developer is needed.

13. An apparatus according to claim 11, wherein when said developing device is a new article, said discriminating portion discriminates, before image formation is started by using said developing device, whether or not stirring of the developer is needed on the basis of the information on the electrostatic capacity between said developer carrying member and said developer supplying member.

* * * * *